US008471838B2

(12) United States Patent
Yamamoto et al.

(10) Patent No.: US 8,471,838 B2
(45) Date of Patent: Jun. 25, 2013

(54) PIXEL CIRCUIT HAVING A LIGHT DETECTION ELEMENT, DISPLAY APPARATUS, AND DRIVING METHOD FOR CORRECTING THRESHOLD AND MOBILITY FOR LIGHT DETECTION ELEMENT OF PIXEL CIRCUIT

(75) Inventors: Tetsuro Yamamoto, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 639 days.

(21) Appl. No.: 12/662,306

(22) Filed: Apr. 9, 2010

(65) Prior Publication Data

US 2010/0289782 A1 Nov. 18, 2010

(30) Foreign Application Priority Data

May 12, 2009 (JP) ..... 2009-115195

(51) Int. Cl.
*G06F 3/038* (2006.01)
*G09G 5/00* (2006.01)
*G09G 3/30* (2006.01)

(52) U.S. Cl.
USPC ..... 345/207; 345/76; 345/81

(58) Field of Classification Search
None
See application file for complete search history.

(56) References Cited

U.S. PATENT DOCUMENTS

| | | | | |
|---|---|---|---|---|
| 8,194,012 | B2 * | 6/2012 | Choi | 345/77 |
| 2004/0046164 | A1 | 3/2004 | Kobayashi et al. | |
| 2005/0140611 | A1 * | 6/2005 | Shih et al. | 345/82 |
| 2005/0179625 | A1 * | 8/2005 | Choi et al. | 345/76 |
| 2005/0206590 | A1 | 9/2005 | Sasaki et al. | |
| 2006/0012311 | A1 * | 1/2006 | Ogawa | 345/92 |
| 2007/0046593 | A1 * | 3/2007 | Shin | 345/81 |
| 2008/0297449 | A1 * | 12/2008 | Yamashita et al. | 345/76 |
| 2009/0174731 | A1 * | 7/2009 | Kim et al. | 345/690 |
| 2009/0243498 | A1 * | 10/2009 | Childs et al. | 315/169.3 |

FOREIGN PATENT DOCUMENTS

| | | | |
|---|---|---|---|
| JP | 2003-255856 | A | 9/2003 |
| JP | 2003-271095 | A | 9/2003 |

* cited by examiner

*Primary Examiner* — Bipin Shalwal
*Assistant Examiner* — Ryan A Lubit
(74) *Attorney, Agent, or Firm* — Rader, Fishman & Grauer PLLC

(57) ABSTRACT

A pixel circuit includes: a light emitting element; a driving transistor for applying current to the light emitting element in response to a signal value applied between a gate and a source thereof when a driving voltage is applied between a drain and the source thereof; first and second capacitors connected in series between the gate and the source of the driving transistor; a sampling transistor connected between the gate of the driving transistor and a predetermined signal line; a switching transistor connected to supply a potential of the signal line to a node between the first and second capacitors; and a light detection element connected between the gate of the driving transistor and the node between the first and second capacitors for supplying current of a current amount in accordance with an emitted light amount of the light emitting element.

11 Claims, 16 Drawing Sheets

$Va \fallingdotseq Vx - Vofs + Vth + \Delta Vs$ $$I_{ds}=\frac{1}{2}\mu\frac{W}{L}C_{ox}(V_{gs}-V_{th})^2$$

PIXEL CIRCUIT HAVING A LIGHT DETECTION ELEMENT, DISPLAY APPARATUS, AND DRIVING METHOD FOR CORRECTING THRESHOLD AND MOBILITY FOR LIGHT DETECTION ELEMENT OF PIXEL CIRCUIT

BACKGROUND OF THE INVENTION

1. Field of the Invention

This invention relates to a pixel circuit formed using, for example, an organic electroluminescence element, that is, an organic EL element, a display apparatus having a pixel array wherein such pixel circuits are disposed in a matrix, and a driving method for the pixel circuit.

Japanese Patent Laid-Open Nos. 2003-255856 and 2003-271095 are known as related art documents to the inventor.

2. Description of the Related Art

In a display apparatus of the active matrix type wherein an organic electroluminescence (EL) light emitting element is used in a pixel, current to flow through a light emitting element in each pixel circuit is controlled by an active element, usually a thin film transistor (TFT), provided in the pixel circuit. In particular, since an organic EL element is a current light emitting element, a gradation of emitted light is obtained by controlling the amount of current to flow through the EL element.

An example of a related art pixel circuit which uses an organic EL element is shown in FIG. 9A.

It is to be noted that, although only one pixel circuit is shown in FIG. 9A, in an actual display apparatus, m×n such pixel circuits as shown in FIG. 9A are disposed in a matrix, that is, an m×n matrix, such that each pixel circuit is selected and driven by a horizontal selector 101 and a write scanner 102.

Referring to FIG. 9A, the pixel circuit shown includes a sampling transistor Ts in the form of an re-channel TFT, a holding capacitor Cs, a driving transistor Td in the form of a p-channel TFT, and an organic EL element 1. The pixel circuit is disposed at a crossing point between a signal line DTL and a write controlling line WSL. The signal line DTL is connected to a terminal of the sampling transistor Ts and the write controlling line WSL is connected to the gate of the sampling transistor Ts.

The driving transistor Td and the organic EL element 1 are connected in series between a power supply potential Vcc and the ground potential. Further, the sampling transistor Ts and the holding capacitor Cs are connected to the gate of the driving transistor Td. The gate-source voltage of the driving transistor Td is represented by Vgs.

In the pixel circuit, if the write controlling line WSL is placed into a selected state and a signal value corresponding to a luminance signal is applied to the signal line DTL, then the sampling transistor Ts is rendered conducting and the signal value is written into the holding capacitor Cs. The signal potential written in the holding capacitor Cs becomes a gate potential of the driving transistor Td.

If the write controlling line WSL is placed into a non-selected state, then the signal line DTL and the driving transistor Td are electrically disconnected from each other. However, the gate potential of the driving transistor Td is kept stably by the holding capacitor Cs. Then, driving current Ids flows through the driving transistor Td and the organic EL element 1 from the power supply potential Vcc toward the ground potential.

At this time, the current Ids exhibits a value corresponding to the gate-source voltage Vgs of the driving transistor Td, and the organic EL element 1 emits light with a luminance in accordance with the current value.

In particular, in the present pixel circuit, a signal value potential from the signal line DTL is written into the holding capacitor Cs to vary the gate application voltage of the driving transistor Td thereby to control the value of current to flow to the organic EL element 1 to obtain a gradation of color development.

Since the driving transistor Td in the form of a p-channel TFT is connected at the source thereof to the power supply potential Vcc and is designed in such a manner as to normally operate in a saturation region, the driving transistor Td serves as a constant current source having a value given by the following expression (1):

$$Ids=(1/2)\cdot\mu\cdot(W/L)\cdot Cox\cdot(Vgs-Vth)^2 \quad (1)$$

where Ids is current flowing between the drain and the source of a transistor which operates in a saturation region, μ the mobility, W the channel width, L the channel length, Cox the gate capacitance, and Vth the threshold voltage of the driving transistor Td.

As apparently recognized from the expression (1) above, in the saturation region, the drain current Ids of the transistor is controlled by the gate-source voltage Vgs. Since the gate-source voltage Vgs is kept fixed, the driving transistor Td operates as a constant current source and can drive the organic EL element 1 to emit light with a fixed luminance.

FIG. 9B illustrates a time-dependent variation of the current-voltage (I-V) characteristic of an organic EL element. A curve shown by a solid line indicates a characteristic in an initial state, and another curve shown by a broken line indicates the characteristic after time-dependent variation. Generally, the I-V characteristic of an organic EL element deteriorates as time passes as seen from FIG. 9B. In the pixel circuit of FIG. 9A, the drain voltage of the driving transistor Td varies together with time-dependent variation of the organic. EL element 1. However, since the gate-source voltage Vgs in the pixel circuit of FIG. 9A is fixed, a fixed amount of current flows to the organic EL element 1 and the emitted light luminance does not vary. In short, stabilized gradation control can be carried out.

However, the organic EL element 1 suffers from a drop not only of the driving voltage but also of the light emission efficiency as time passes. In particular, even if the same current flows, the emitted light luminance degrades together with passage of time. As a result, a screen burn occurs that, if a white WINDOW pattern is displayed on the black background and then the white is displayed on the screen as shown, for example, in FIG. 10A, then the luminance at the portion at which the WINDOW pattern is displayed decreases.

In order to compensate for the drop of the light emission efficiency of the organic. EL element 1, such a pixel circuit as shown in FIGS. 11A and 11B has been proposed. Referring to FIG. 11A, the pixel circuit shown includes, in addition to the component of such a pixel circuit as described above with reference to FIG. 9A, a light detection element D1 in the form of, for example, a diode interposed between the gate of the driving transistor Td and the fixed potential.

If the light detection element D1 detects light, then the current therethrough increases. The increasing amount of the current varies in response to the amount of light incident to the light detection element D1. In this instance, the light detection element D1 supplies current in accordance with the amount of emitted light from the organic EL element 1.

For example, when the white is displayed, the light detection element D1 detects emitted light of the organic EL element 1 and supplies current from the fixed power supply to the gate of the driving transistor Td as seen in FIG. 11A. At this time, the gate-source voltage of the driving transistor Td decreases and the current flowing to the organic EL element 1 decreases.

It is assumed that, while the white display is maintained, the emitted light luminance decreases due to a drop of the efficiency of the organic EL element 1 or from some other reason after lapse of a fixed period of time. In this instance, as seen from FIG. 11B, the amount of light incident to the light detection element D1 decreases due to the drop of the emitted light luminance and the value of current flowing from the fixed power supply to the gate of the driving transistor Td decreases. Therefore, the gate-source voltage of the driving transistor Td increases and the current flowing to the organic EL element 1 increases.

As a result, even if the emitted light luminance degrades, the operation of adjusting the amount of current to flow to the organic EL element 1 is carried out by the light detection element D1, and a screen burn arising from a variation of the efficiency of the organic EL element 1 is moderated. For example, the screen burn is reduced as seen in FIG. 10B.

SUMMARY OF THE INVENTION

Here, if the driving transistor Td is formed from an n-channel TFT, then it becomes possible to use a related art amorphous silicon (a-Si) process in TFT fabrication. This makes it possible to reduce the cost of a TFT substrate and obtain a large screen.

FIG. 12 shows a configuration wherein the driving transistor Td in the form of a p-channel TFT of the pixel circuit shown in FIG. 11A is replaced with an n-channel TFT.

Referring to FIG. 12, in the configuration shown, the holding capacitor Cs is connected between the gate and the source of the driving transistor Td. Further, a driving voltage Vcc and an initial voltage Vss are applied alternately to the power supply controlling line DSL by the drive scanner 103. In short, the driving voltage Vcc and the initial voltage Vss are applied at predetermined timings to the driving transistor Td.

The light detection element D1 is connected between the driving transistor Td and a fixed power supply V1. The fixed power supply V1 needs be a potential lower than the gate potential of the driving transistor Td upon light emission and preferably is equal to a cathode potential Vcat.

It is to be noted that the driving transistor Td supplies such current Ids as defined by the expression (1) given hereinabove to the EL element in response to the gate-source voltage Vgs thereof. As can be recognized from the expression (1), the value of the current Ids varies depending much upon the mobility p of the driving transistor Td, the gate insulating film capacitance Cox per unit area and the threshold voltage Vth.

The pixel circuit of FIG. 12 is configured taking a countermeasure also against a dispersion of the threshold voltage Vth and the mobility p of the driving transistor Td.

FIG. 13 illustrates driving timings of the pixel circuit of FIG. 12 and a variation of the gate voltage and the source voltage of the driving transistor Td.

Referring to FIG. 13, as driving timings, a scanning pulse WS which is applied from the write scanner 102 to the gate of the sampling transistor Ts through the power supply controlling line WSL and a power supply pulse DS which is supplied from the drive scanner 103 through the power supply controlling line DSL are illustrated.

Further, as a DTL input signal, a potential applied from the horizontal selector 101 to the signal line DTL is illustrated. The potential is a signal value Vsig or a potential of a reference value Vofs.

Operation of the pixel circuit is described with reference to equivalent circuits and so forth of FIGS. 14A to 14C, 15A to 15C and 16A to 16C.

First, till the point of time t10 of FIG. 13, light emission within a period of a preceding frame is carried out. In this light emitting state, the power supply pulse DS of the power supply controlling line DSL has the driving voltage Vcc as seen in FIG. 14A and the sampling transistor Ts is in an off state.

At this time, since the driving transistor Td is set so as to operate in a saturation region thereof, the current Ids flowing to the organic EL element 1 assumes the value defined by the expression (1) given hereinabove in response to the gate-source voltage Vgs of the driving transistor Td.

Further, the light detection element D1 supplies current Ib from the gate of the driving transistor Td to the fixed power supply V1 in response to emission of light of the organic EL element 1 to vary the gate potential of the driving transistor Td.

At time t10 of FIG. 13, pixel operation of one cycle for a current frame is started. At time t10, the power supply pulse DS of the power supply controlling line DSL is set to the initial potential Vss as seen in FIG. 14B.

At this time, if the source potential Vs of the driving transistor Td is lower than the sum of the threshold value Vthel of the organic EL element 1 and the cathode potential Vcat, that is, if $Vs<Vthel+Vcat$ is satisfied, then the organic EL element 1 turns off to stop the emission of light and the power supply controlling line DSL becomes the source of the driving transistor Td. At this time, the anode of the organic EL element 1 is charged up to the initial voltage Vss.

At next time t11 of FIG. 13, the potential of the signal line DTL is set to the reference value Vofs, and then at time t12, the sampling transistor Ts is turned on to set the gate potential of the driving transistor Td to the reference value Vofs as seen in FIG. 14C.

At this time and within a period from time t12 to time t13, the gate-source voltage of the driving transistor Td assumes the value $Vofs-Vss$. If this value $Vofs-Vss$ is not higher than the threshold voltage Vth, then the threshold value correction operation cannot be carried out, and therefore, $Vofs-Vss>Vth$ must be satisfied. Here, while the light detection element D1 supplies current between the gate of the driving transistor Td and the fixed power supply V1, if the organic EL element 1 does not emit light and besides the light detection element D1 is operating in an off region, then little influence is had on the gate of the driving transistor Td.

Next, the threshold value correction operation is carried out within a period from time t13 to time t14. In this instance, the power supply pulse DS of the power supply controlling line DSL is set to the driving potential Vcc. Consequently, the anode of the organic EL element 1 serves as the source of the driving transistor Td, and current flows as indicated by an alternate long and short dash line of FIG. 15A. Here, the equivalent circuit of the organic EL element 1 is represented by a diode and a capacitor Cel as seen in FIG. 15A. Therefore, the current of the driving transistor Td is used to charge up the capacitor Cs and the capacitor Cel as long as the anode potential Vel of the organic EL element 1 satisfies $Vel \leqq Vcat+Vthel$, that is, the leak current of the organic EL element 1 is considerably smaller than the current flowing to the driving transistor Td.

At this time, the anode potential Vel of the organic EL element 1, that is, the source potential of the driving transistor Td, rises as time passes as seen in FIG. 15B.

After lapse of a fixed period of time, the gate-source voltage of the driving transistor Td assumes the value of the threshold voltage Vth. At this time, Vel=Vofs−Vth≦Vcat+Vthel is satisfied. The above-described operation is carried out within a period from time t13 to time t14, and at time t14, the scanning pulse WS falls and the sampling transistor Ts is turned off to complete the threshold value correction operation as seen in FIG. 15C.

Then at time t15, the signal line potential becomes the signal value Vsig, and then at time t16, the sampling transistor Ts is turned on so that the signal value potential Vsig is inputted to the gate of the driving transistor Td as seen in FIG. 16A. The signal value potential Vsig indicates a voltage corresponding to a gradation.

Since the sampling transistor Ts is on, the gate potential of the driving transistor Td becomes the potential of the signal value potential Vsig. However, since the driving voltage Vcc is applied to the power supply controlling line DSL, current flows, and the source potential of the sampling transistor Ts rises as time passes. At this time, if the source voltage of the driving transistor Td does not exceed the sum of the threshold voltage Vthel and the cathode potential Vcat of the organic EL element 1, that is, if the leak current of the organic EL element 1 is considerably smaller than the current flowing to the driving transistor Td, then the current of the driving transistor Td is used to charge up the capacitors Cs and Cel.

Then at this time, since the threshold value correction operation of the driving transistor Td has been completed, the current supplied from the driving transistor Td represents the mobility p. In particular, where the mobility is high, the amount of current at this time is great, and also the speed of the rise of the source potential is high. On the contrary, where the mobility is low, the amount of current at this time is small, and also the speed of the rise of the source potential is low (FIG. 16B). Consequently, the gate-source voltage of the driving transistor Td decreases reflecting the mobility, and after lapse of a fixed period of time, it becomes equal to the voltage with which the mobility is corrected fully.

Also here, the light detection element D1 supplies current between the gate of the driving transistor Td and the fixed power supply V1. However, if the organic EL element 1 does not emit light and besides the diode as the light detection element D1 is operating in an off region, then little influence is had on the gate of the driving transistor Td.

At time t17, the sampling transistor Ts is turned off to end the writing, and the organic EL element 1 emits light. Since the gate-source voltage of the driving transistor Td is fixed, the driving transistor Td supplies fixed current Ids' to the organic EL element 1. As seen in FIG. 16C, the anode potential Vel of the organic EL element 1 rises to a voltage Vx with which the fixed current Ids' flows to the organic EL element 1, and the organic EL element 1 emits light.

In the light emitting period after time t17, the light detection element D1 supplies current Ib from the gate of the driving transistor Td to the fixed power supply in response to emission of light of the organic EL element 1 to vary the gate-source voltage Vgs thereby to adjust the current Ids' to flow to the organic EL element 1.

In this pixel circuit, if the light emitting time of the organic EL element 1 becomes long, then the I-V characteristic of the organic EL element 1 varies and also the efficiency varies. Therefore, also the potential at a point B shown in FIG. 16C varies. However, the gate-source voltage Vgs of the driving transistor Td is kept at a fixed value by the holding capacitor Cs and besides the light detection element D1 varies the gate-source voltage Vgs of the driving transistor Td depending upon the emitted light luminance of the organic EL element 1. Therefore, it is possible to establish a state wherein the emitted light luminance of the organic EL element 1 does not vary. Therefore, even if the I-V characteristic or the light emission efficiency of the organic EL element 1 degrades, the luminance of the organic EL element 1 does not vary.

Here, the light detection element D1 in the form of a diode is studied. The light detection element reacts with light to increase the current value thereof. In the pixel circuit described hereinabove with reference to FIG. 11A, the voltage across the diode used as the light detection element D1 is given by Vcc−Vsig and has a fixed value. In contrast, in the pixel circuit described hereinabove with reference to FIG. 12, the light detection element D1 is connected between the gate of the driving transistor Td and the fixed power supply V1. The gate-source voltage of the driving transistor Td disperses for each pixel by an influence of threshold voltage correction and mobility correction. If the threshold voltage Vth is high, then the gate voltage of the driving transistor Td is high, and if the mobility is low, then the gate voltage of the driving transistor Td is high. It is to be noted that the gate voltage of the driving transistor Td is influenced by the dispersion in threshold value rather than by the dispersion in mobility.

That the gate potential varies depending upon the dispersion in threshold voltage or mobility of the driving transistor Td in this manner signifies that the operating point of the light detection element D1 varies. Consequently, the adjustment operation by the light detection element D1 disperses for each pixel, and as a result, a problem that unevenness or roughness appears with a display image occurs.

Therefore, it is desirable to provide a pixel circuit, a display apparatus and a driving method for the pixel circuit wherein a dispersion in adjustment operation by a light detection element can be eliminated so that a display image of high quality can be obtained.

According to an embodiment of the present invention, there is provided a pixel circuit including: a light emitting element; a driving transistor for applying current to the light emitting element in response to a signal value applied between a gate and a source thereof when a driving voltage is applied between a drain and the source thereof; first and second capacitors connected in series between the gate and the source of the driving transistor; a sampling transistor connected between the gate of the driving transistor and a predetermined signal line; a switching transistor connected to supply a potential of the signal line to a node between the first and second capacitors; and a light detection element connected between the gate of the driving transistor and the node between the first and second capacitors for supplying current of a current amount in accordance with an emitted light amount of the light emitting element.

The switching transistor may be connected between the node of the first and second capacitors and the signal line.

Alternatively, the switching transistor may be connected between the node between the first and second capacitors and the gate of the driving transistor.

The light detection element and a detection period controlling transistor may be connected in series between the gate of the driving transistor and the node between the first and second capacitors.

According to another embodiment of the present invention, there is provided a display apparatus including: a plurality of signal lines disposed on a pixel array, in which a plurality of pixel circuits are disposed in a matrix, so as to extend in the direction of a column, a plurality of power supply controlling lines, a plurality of first write controlling lines and a plurality of second write controlling lines disposed on the pixel array so as to extend in the direction of a row; and a light emission driving section configured to drive the power supply controlling lines, first write controlling lines and second write controlling lines, and apply the signal value to each of the pixel circuits of the pixel array through the signal lines to cause the pixel circuits to emit light with a luminance corresponding to the signal value. The pixel circuits are individually disposed at crossing points between the signal lines and the power supply controlling lines, first write controlling lines and second write controlling lines. Each of the pixel circuits includes: a light emitting element; a driving transistor for applying current to the light emitting element in response to a signal value applied between a gate and a source thereof when a driving voltage is applied between a drain and the source thereof; first and second capacitors connected in series between the gate and the source of the driving transistor; and a sampling transistor connected between the gate of the driving transistor and an associated one of the signal lines and controlled between a conducting state and a non-conducting state with a potential of an associated one of the first write controlling lines. Each of the pixel circuits further includes: a switching transistor connected to supply a potential of the signal line to a node between the first and second capacitors and controlled between a conducting state and a non-conducting state with a potential of an associated one of the second write controlling lines; and a light detection element connected between the gate of the driving transistor and the node between the first and second capacitors for supplying current in accordance with an emitted light amount of the light emitting element.

According to a further embodiment of the present invention, there is provided a driving method for a pixel circuit which includes a light emitting element, a driving transistor for applying current to the light emitting element in response to a signal value applied between a gate and a source thereof when a driving voltage is applied between a drain and the source thereof, first and second capacitors connected in series between the gate and the source of the driving transistor, a sampling transistor connected between the gate of the driving transistor and a predetermined signal line, a switching transistor connected to supply a potential of the signal line to a node between the first and second capacitors, and a light detection element connected between the gate of the driving transistor and the node between the first and second capacitors for supplying current of a current amount in accordance with an emitted light amount of the light emitting element. The driving method includes the steps carried out within a write emission operation period of one cycle of: applying a potential as the reference value to the signal line and rendering the sampling transistor and the switching transistor conducting to fix a gate potential of the driving transistor and a potential at the node between the first and second capacitors to the reference value; applying a driving voltage to the driving transistor to execute a threshold value correction operation of the driving transistor; and applying a potential as the signal value to the signal line and rendering the sampling transistor conducting while rendering the switching transistor non-conducting so that writing of the signal value and a mobility correction operation of the driving transistor, whereafter current corresponding to a gate-source voltage of the driving transistor is supplied to the light emitting element to carry out emission of light from the light emitting element with a luminance corresponding to the signal value.

In the pixel circuit and the driving method, the voltage across the light detection element can be controlled appropriately. Consequently, the influence of the voltage applied to the light detection element by the threshold value correction operation can be eliminated and also the influence of the mobility can be reduced.

With the pixel circuit, display apparatus and driving method for a pixel circuit, the influence of the threshold voltage of the driving transistor on the voltage to be applied to the light detection element for detecting emitted light from the light emitting element such as an organic EL element can be eliminated and also the influence of the mobility can be reduced. Therefore, it is possible to substantially fix the voltage to be applied to the light detection element, and the dispersion in current arising from a dispersion in operating point of the light detection element can be reduced. Consequently, an emitted light adjustment operation free from a dispersion for each pixel is implemented, and correction against a screen burn can be carried out with a higher degree of accuracy and a uniform image of high picture quality can be achieved.

Further, where the light detection element and the detection period controlling transistor are connected in series between the gate of the driving transistor and the node between the first and second capacitors, the light detection period can be set freely by turning on/off of the detection period controlling transistor. For example, it is possible for correction against a screen burn to be applied excessively.

DETAILED DESCRIPTION OF THE PREFERRED EMBODIMENTS

In the following, preferred embodiments of the present invention are described in detail in the following order with reference to the accompanying drawings.

1. Configuration of the Display Apparatus
2. First Pixel Circuit Configuration
3. Pixel Circuit Operation 4. Second Pixel Circuit Configuration 5. Third Pixel Circuit Configuration 1. Configuration of the Display Apparatus FIG. 1 shows a configuration of an organic EL display apparatus to which the present invention is applied.

Figure 1:
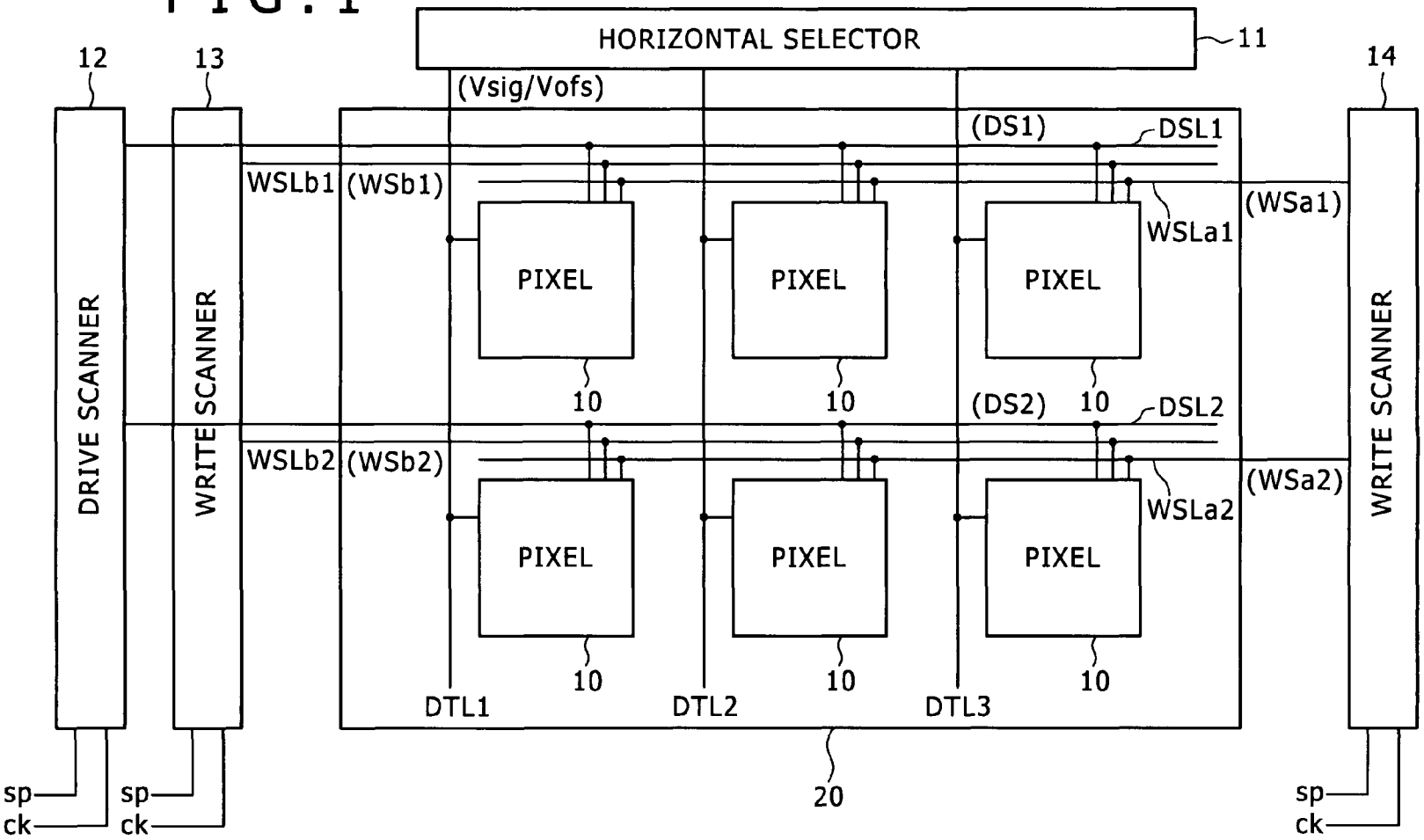
FIG. 1 is a block diagram of a display apparatus to which an embodiment of the present invention is applied.

Referring to FIG. 1, the organic EL display apparatus shown includes a plurality of pixel circuits 10 which use an organic EL element as a light emitting element thereof and are driven to emit light in accordance with an active matrix method.

In particular, the organic EL display apparatus includes a pixel array 20 including a large number of pixel circuits 10 arrayed in a matrix, that is, in m rows and n columns. It is to be noted that each of the pixel circuits 10 serves as a light emitting pixel for red (R) light, green (G) light or blue (B) light and the pixel circuits 10 of the colors are arrayed in a predetermined rule to form the color display apparatus.

The organic EL display apparatus includes, as components for driving the pixel circuits 10 to emit light, a horizontal selector 11, a drive scanner 12, a first write scanner 13 and a second write scanner 14.

Signal lines DTL1, DTL2, . . . for being selected by the horizontal selector 11 to supply a voltage corresponding to a signal value or gradation value of a luminance signal as display data are disposed so as to extend in the direction of a column on the pixel array 20. The number of such signal lines DTL1, DTL2, . . . is equal to the number of columns of the pixel circuits 10 disposed in a matrix on the pixel array 20.

Further, first write controlling lines WSLa1, WSLa2, . . . , second write controlling lines WSLb1, WSLb2, . . . and power supply controlling lines DSL1, DSL2, . . . are disposed so as to extend in the direction of a row on the pixel array 20. The number of such first and second write controlling lines WSLa and WSLb and power supply controlling lines DSL is equal to the number of rows of the pixel circuits 10 disposed in a matrix on the pixel array 20.

The write controlling lines WSLa, that is, WSLa1, WSLa2, . . . , are driven by the write scanner 13. The write scanner 13 successively supplies scanning pulses WSa, that is, WSa1, WSa2, . . . , to the write controlling lines WSLa1, WSLa2, . . . disposed in the direction of a row at predetermined timings to line-sequentially scan the pixel circuits 10 in a unit of a row.

The write controlling lines WSLb, that is, WSLb1, WSLb2, . . . , are driven by the write scanner 14. The write scanner 14 successively supplies scanning pulses WSb, that is, WSb1, WSb2, . . . , to the write controlling lines WSLb1, WSLb2, . . . disposed in the direction of a row at predetermined timings to control the operation of the pixel circuits 10.

The power supply controlling lines DSL, that is, DSL1, DSL2, . . . , are driven by the drive scanner 12. The drive scanner 12 supplies power supply pulses DS, that is, DS1, DS2, . . . , as power supply voltages, which are changed over between two values of a driving potential Vcc and an initial voltage Vss, to the power supply controlling lines DSL1, DSL2, . . . , in a timed relationship with the line-sequential scanning by the write scanner 13.

It is to be noted that the drive scanner 12 and the write scanners 13 and 14 set the timing of the scanning pulses WSa and WSb and the power supply pulses DS based on a clock ck and a start pulse sp.

The horizontal selector 11 supplies a signal value potential Vsig as an input signal to the pixel circuits 10 and a reference value potential Vofs to the signal lines DTL1, DTL2, . . . disposed in the direction of a column in a timed relationship with the line-sequential scanning by the write scanner 13.

2. First Pixel Circuit Configuration

Figure 2:
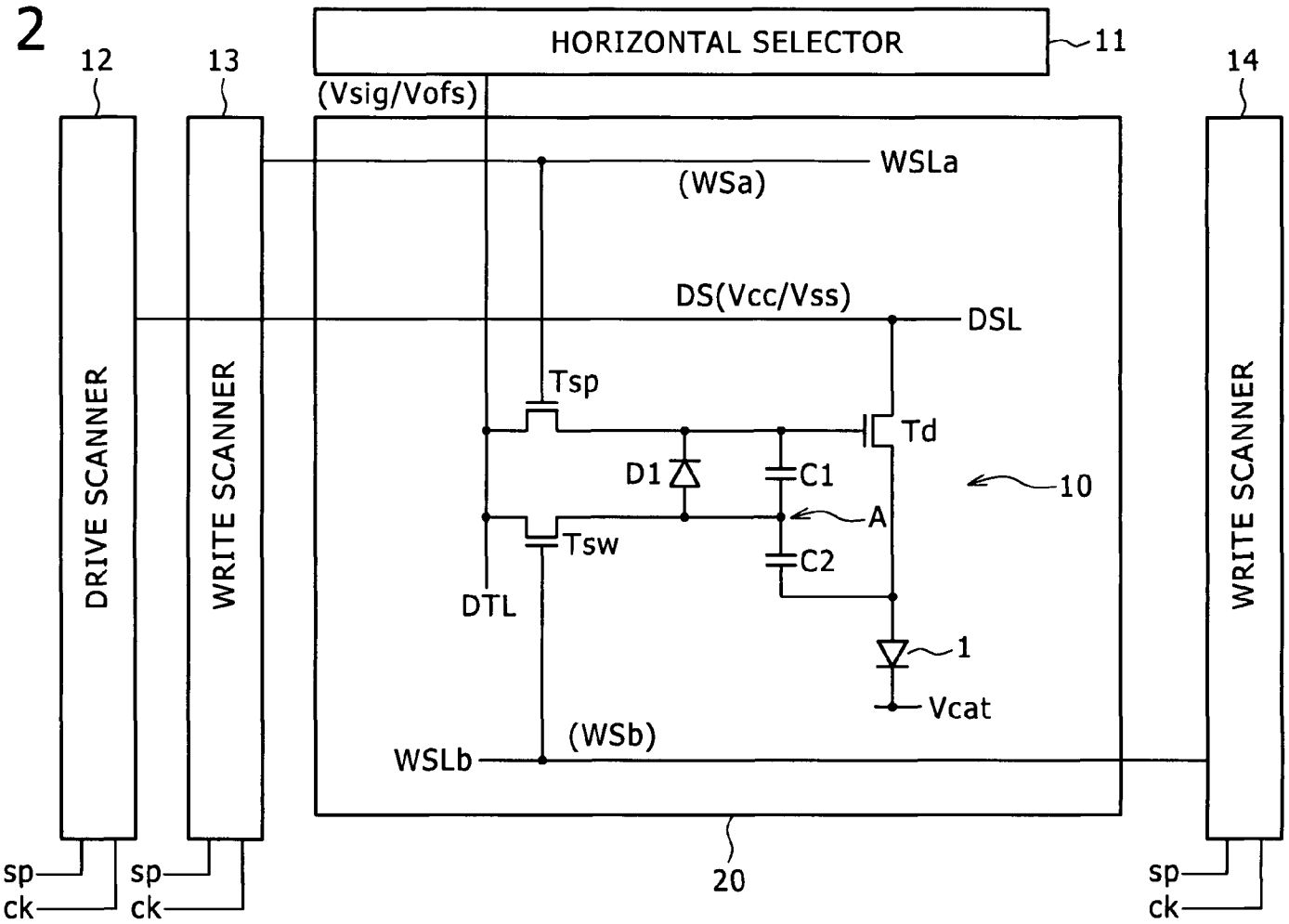
FIG. 2 is a block circuit diagram of a pixel circuit according to a first embodiment of the present invention.

FIG. 2 shows an example of a configuration of a pixel circuit 10. Such pixel circuits 10 are disposed in a matrix like the pixel circuits 10 in the configuration of FIG. 1. It is to be noted that, in FIG. 2, only one pixel circuit 10 disposed at a location at which a signal line DTL crosses with write controlling lines WSLa and WSLb and a power supply controlling line DSL is shown for simplified illustration.

Referring to FIG. 2, the pixel circuit 10 includes an organic EL element 1 serving as a light emitting element and two capacitors C1 and C2 connected in series. The pixel circuit 10 further includes thin film transistors (TFTs) serving as a sampling transistor Tsp, a driving transistor Td and a switching transistor Tsw. The pixel circuit 10 further includes a light detection element D1.

The capacitors C1 and C2 are connected in series between the gate and the source of the driving transistor Td.

The light emitting element of the pixel circuit 10 is an organic EL element 1 of, for example, a diode structure and has an anode and a cathode. The organic EL element 1 is connected at the anode thereof to the source, of the driving transistor Td and at the cathode thereof to a predetermined wiring line, that is, to a cathode potential Vcat.

The sampling transistor Tsp is connected at one of the drain and the source thereof to the signal line DTL and at the other one of the drain and the source thereof to the gate of the driving transistor Td. Further, the sampling transistor Tsp is connected at the gate thereof to the first write controlling line WSLa.

The driving transistor Td is connected at one of the drain and the source thereof to a power supply controlling line DSL and at the other one of the drain and the source thereof to the anode of the organic EL element 1.

The switching transistor Tsw is connected at one of the drain and source thereof to a signal line DTL and at the other of the drain and the source thereof to a node between the capacitors C1 and C2, that is, at a point A. Further, the switching transistor Tsw is connected at the gate thereof to a second write controlling line WSLb.

The light detection element D1 is connected in parallel to the capacitor C1 between the gate of the driving transistor Td and the node of the capacitors C1 and C2.

The light detection element D1 is fabricated generally using a PIN diode or an amorphous silicon element. However, any element can be used only if the amount of current therethrough varies in response to light. In the present example, the light detection element D1 is formed, for example, from a diode connection of a transistor.

The light detection element D1 is disposed so as to detect light emitted from the organic EL element 1. Then, the current through the light detection element D1 varies in response to the detected light amount. In particular, if the amount of emitted light of the organic EL element 1 is great, then the current increasing amount is great, but if the emitted light amount of the organic EL element 1 is small, then the current increasing amount is small.

Light emission driving of the organic EL element 1 is carried out basically in the following manner.

At a timing at which a signal value potential Vsig is applied to the signal line DTL, a sampling transistor Tsp is rendered conducting by a scanning pulse WSa provided thereto from the write scanner 13 through the write controlling line WSLa. Consequently, the signal value Vsig from the signal line DTL is applied to the gate of the driving transistor Td. In this instance, the signal value Vsig is added to the gate-source voltage of the driving transistor Td held by the capacitors C1 and C2.

The driving transistor Td receives supply of current from the power supply controlling line DSL to which the driving potential Vcc is applied from the drive scanner 12 and supplies current in accordance with the gate-source voltage to the organic EL element 1 to cause the organic EL element 1 to emit light.

In short, while operation that the signal value potential Vsig, that is, a gradation value, is written within each frame period, the gate-source voltage Vgs of the driving transistor Td is determined in response to a gradation to be displayed.

Since the driving transistor Td operates in its saturation region, it functions as a constant current source to the organic EL element 1 and supplies current IEL in accordance with the gate-source voltage Vgs to the organic EL element 1. Consequently, the organic EL element 1 emits light of the luminance corresponding to the gradation value.

Further, in the case of the pixel circuit of FIG. 2, operation for moderating a screen burn is carried out by the light detection element D1.

As described above, the current through the light detection element D1 varies in response to the amount of emitted light of the organic EL element 1.

In particular, the light detection element D1 supplies current from one to the other of the terminals of the capacitor C1 in response to the emitted light amount of the organic EL element 1. Here, if the emitted light luminance drops due to a drop of the efficiency of the organic EL element 1 or by some other cause, then the amount of light incident to the light detection element D1 decreases, and the amount of current flowing from one to the other of the terminals of the capacitor C1 decreases. Consequently, the gate potential of the driving transistor Td varies. In particular, the gate-source voltage of the driving transistor Td increases and the current flowing to the organic EL element 1 increases.

Figure 10A:
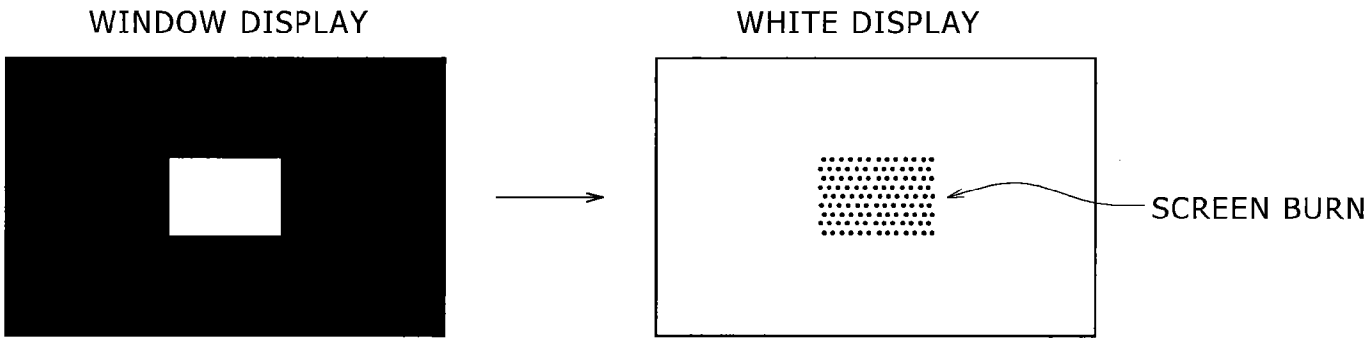
FIG.10A RELATED ART
FIGS. 10A and 10B are schematic views illustrating correction against a screen burn.
Figure 10B:
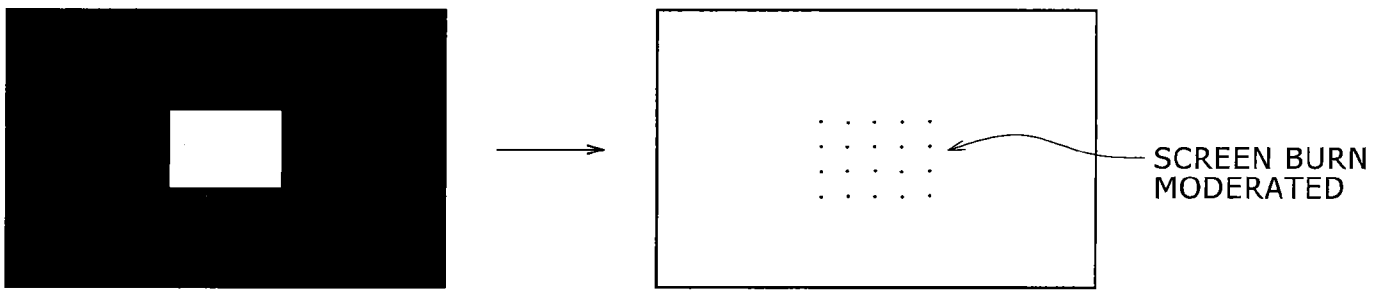
FIG.10B RELATED ART
Figure 11A:
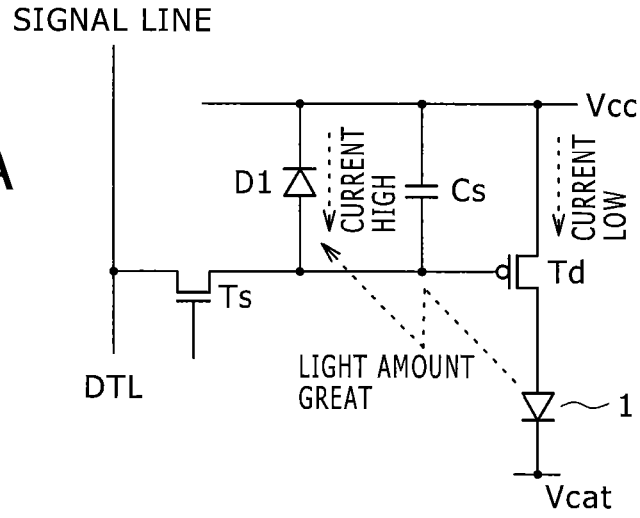
FIG.11A RELATED ART
FIGS. 11A and 11B are circuit diagrams showing a related art pixel circuit which carries out correction against a screen burn.
Figure 11B:
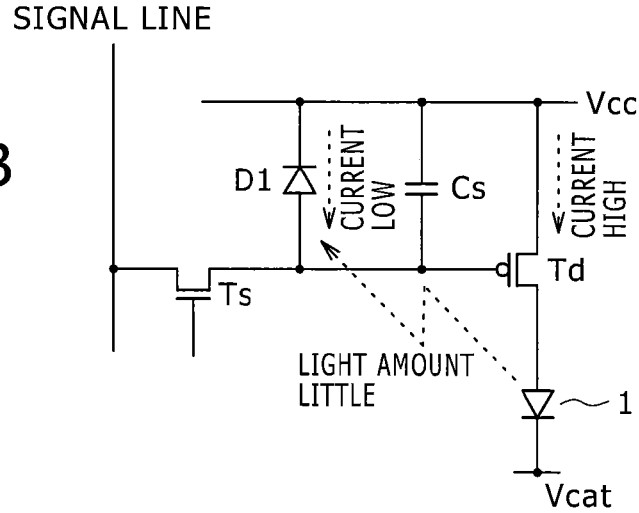
FIG.11B RELATED ART
Figure 12:
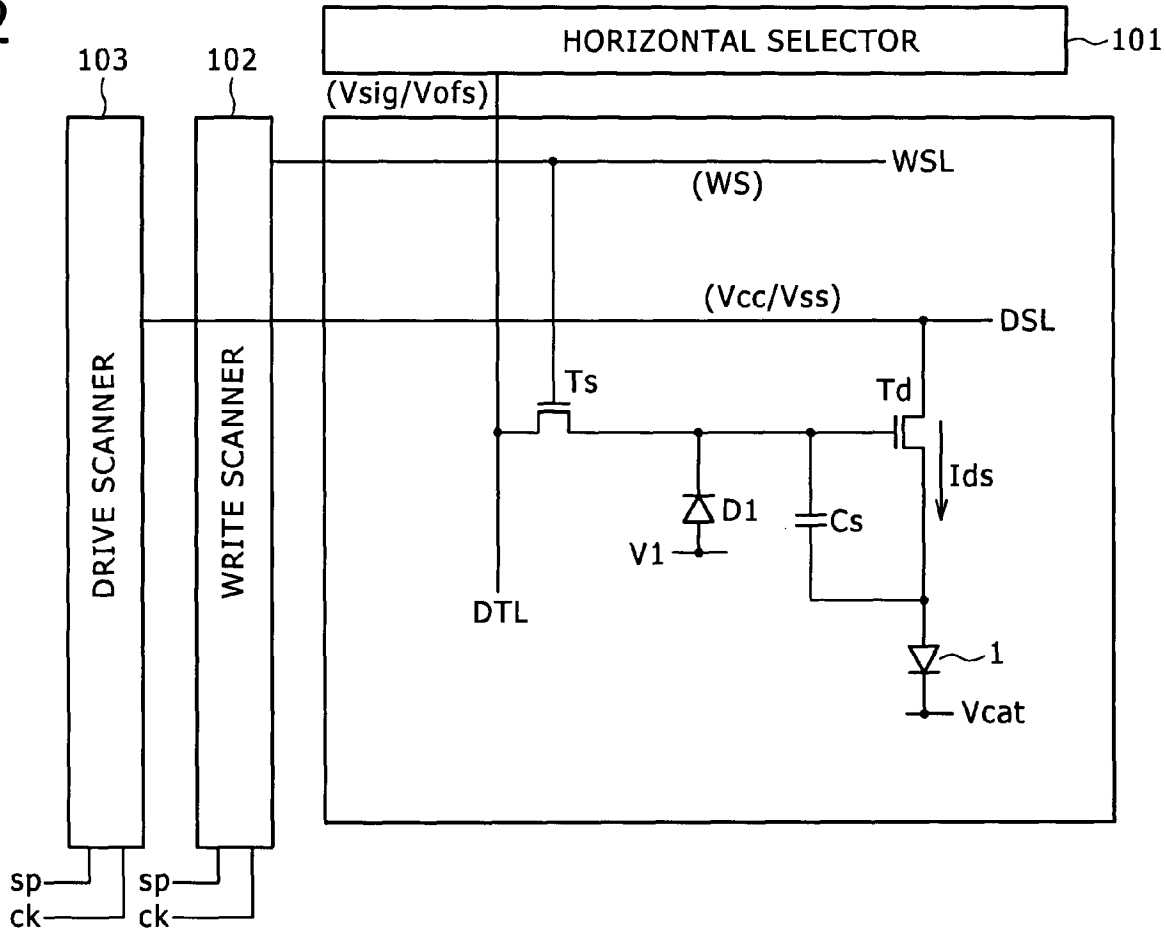
FIG. 12 is a block circuit diagram of a pixel circuit which is formed using an n-channel TFT and carries out correction against a screen burn.
Figure 13:
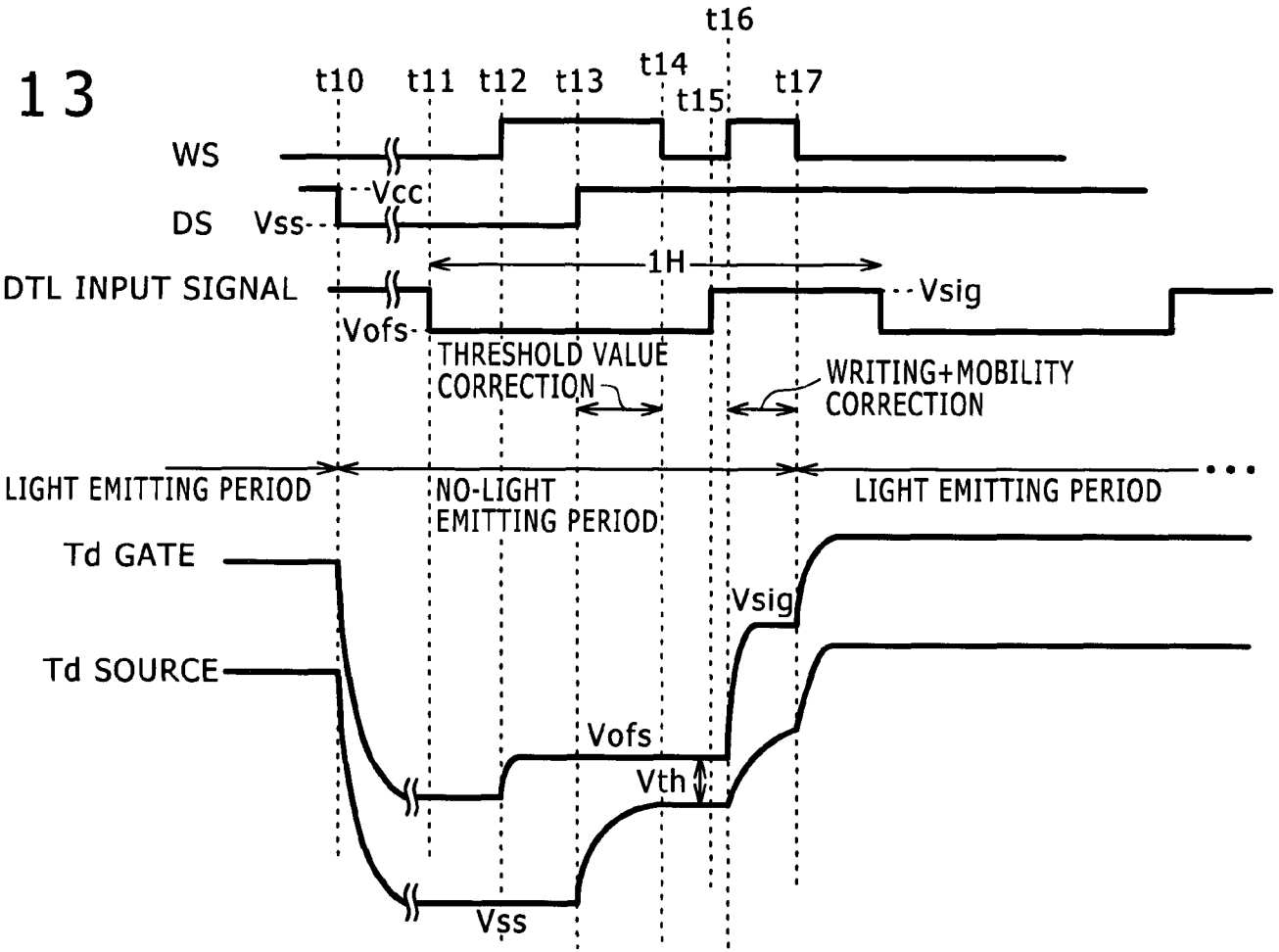
FIG. 13 illustrates driving timings of the pixel circuit of FIG. 12.
Figure 14A:
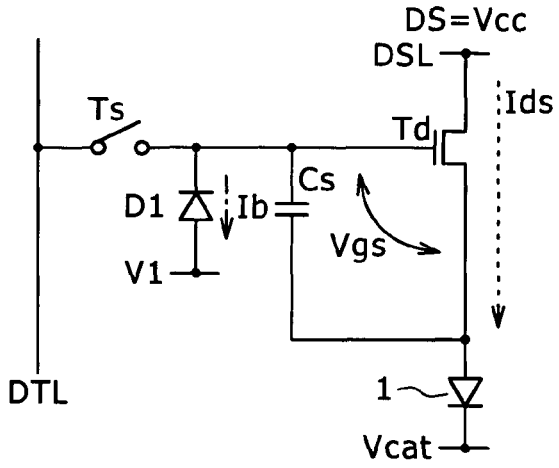
FIGS. 14A to 14C, 15A and 15C, and 16A and 16C are circuit diagrams of equivalent circuits of the pixel circuit shown in FIG. 12 illustrating operation of the circuit
Figure 14B:
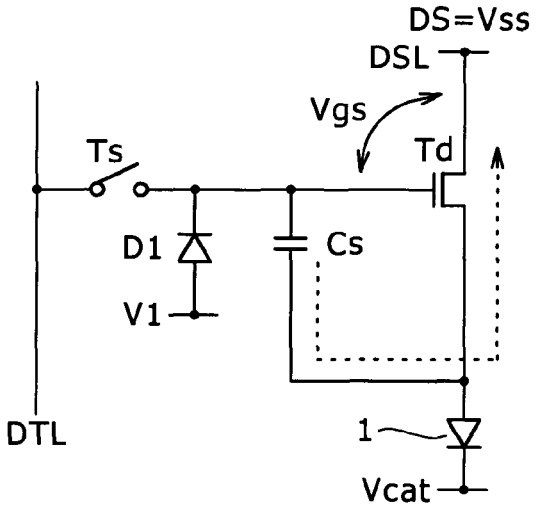
Figure 14C:
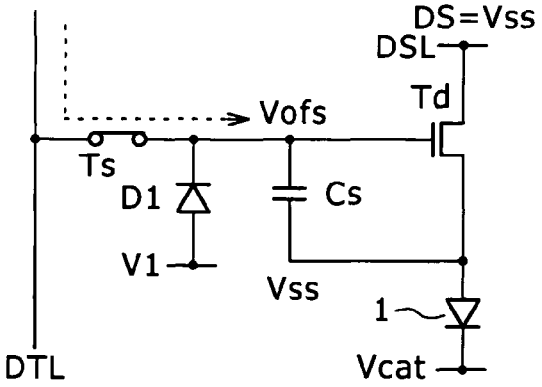
Figure 15A:
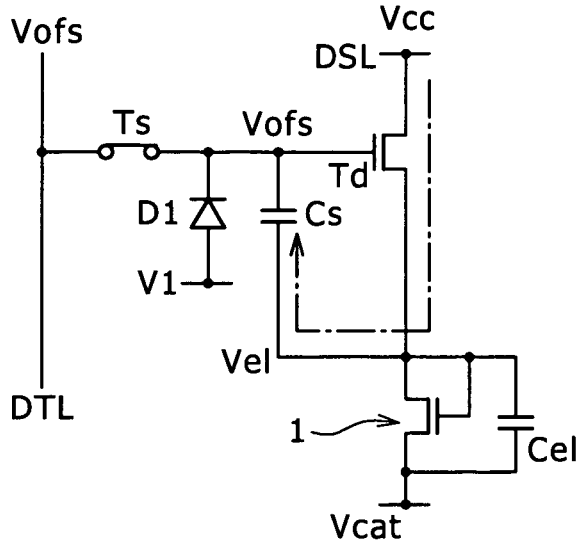
Figure 15B:
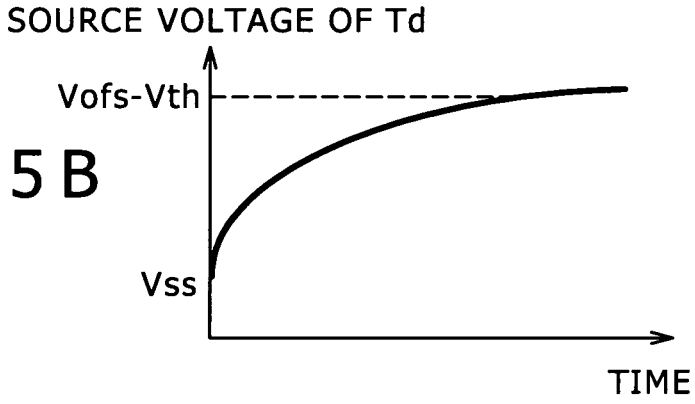
FIGS. 15B and 16B are diagrammatic views illustrating characteristics of the circuits.
Figure 15C:
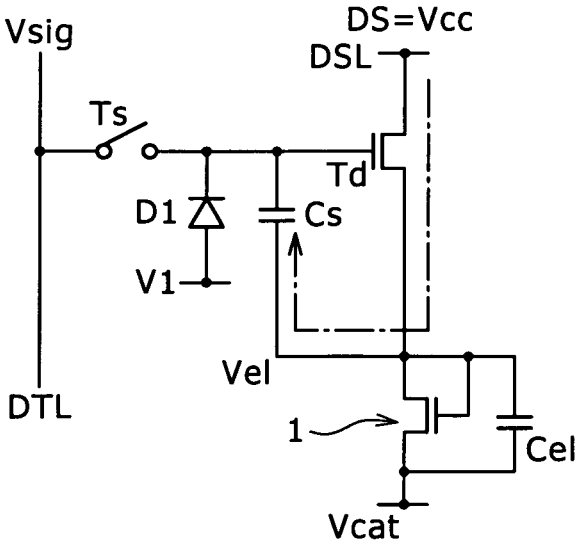

By such operation, adjustment of the amount of current to flow to the organic EL element 1 is carried out even if the luminance of emitted light degrades, and a screen burn arising from a variation in efficiency of the organic EL element 1 can be reduced. The screen burn is moderated, for example, as seen in FIG. 10B.

3. Pixel Circuit Operation

Here, in the present embodiment, variation of the operating point of the light detection element D1 by a dispersion in threshold voltage or mobility of the driving transistor Td is prevented together with reduction of a screen burn. In the following, operation of the pixel circuit 10 is described in detail.

Figure 3:
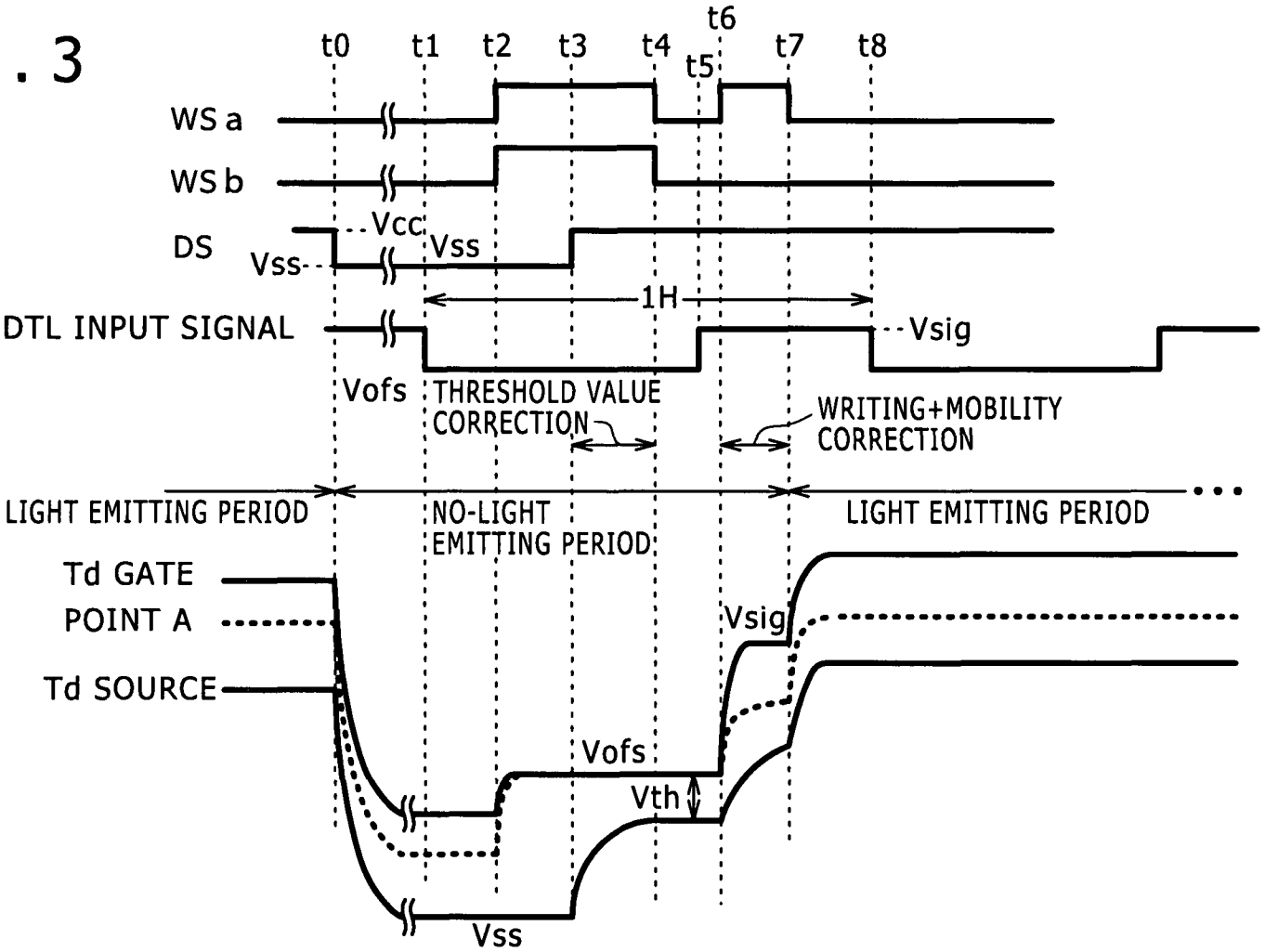
FIG. 3 is a timing chart illustrating operation waveforms of the pixel circuit of FIG. 2.

FIG. 3 illustrates operation waveforms of the pixel circuit 10.

Referring to FIG. 3, a scanning pulse WSa applied to the gate of the sampling transistor Tsp from the write scanner 13 through the first write controlling line WSLa.

Also, a scanning pulse WSb applied to the gate of the switching transistor Tsw from the write scanner 14 through the second write controlling line WSLb.

Further, a power supply pulse DS supplied from the drive scanner 12 through the power supply controlling line DSL are illustrated. As the power supply pulse DS, the driving voltage Vcc or the initial voltage Vss is applied.

Meanwhile, as a DTL input signal, a potential provided to the signal line DTL from the horizontal selector 11 is illustrated. The potential is given as the signal value potential Vsig or the reference value potential Vofs.

Further, a variation of the gate voltage and a variation of the source voltage of the driving transistor Td are illustrated as a waveform denoted by Td gate and a waveform denoted by Td source, respectively.

Also a potential variation at the point A which is the node between the capacitors C1 and C2 is indicated by a broken line.

Equivalent circuits shown in FIGS. 4A to 5C illustrate the process of operation in FIG. 3.

Figure 4A:
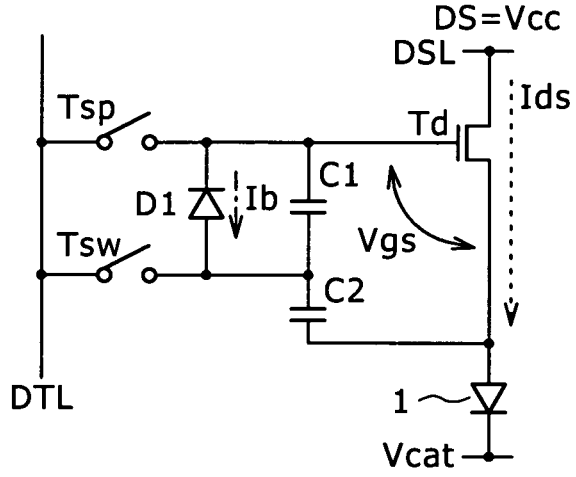
FIGS. 4A to 4C and 5A to 5C are equivalent circuit diagrams illustrating operation of the pixel circuit of FIG. 2.

Till time t0 in FIG. 3, light emission in a preceding frame is carried out. The equivalent circuit in this light emitting state is such as shown in FIG. 4A. In particular, the driving voltage Vcc is supplied to the power supply controlling line DSL. The sampling transistor Tsp and switching transistor Tsw are in an off state. At this time, since the driving transistor Td is set so as to operate in the saturation region thereof, the current Ids flowing to the organic EL element 1 assumes a value indicated by the expression (1) given hereinabove in accordance with the gate-source voltage Vgs of the driving transistor Td.

Further, the light detection element D1 supplies current Ib from one to the other of the terminals of the capacitor C1 in response to emission of light of the organic EL element 1 to vary the gate potential of the driving transistor Td thereby to carry out adjustment operation against degradation of the organic EL element 1.

After time t0 of FIG. 3, operation for one cycle for light emission in a present frame is carried out. This one cycle is a period up to a timing corresponding to time t0 in a next frame.

At time t0, the drive scanner 12 sets the power supply controlling line DSL to the initial voltage Vss.

Figure 4B:
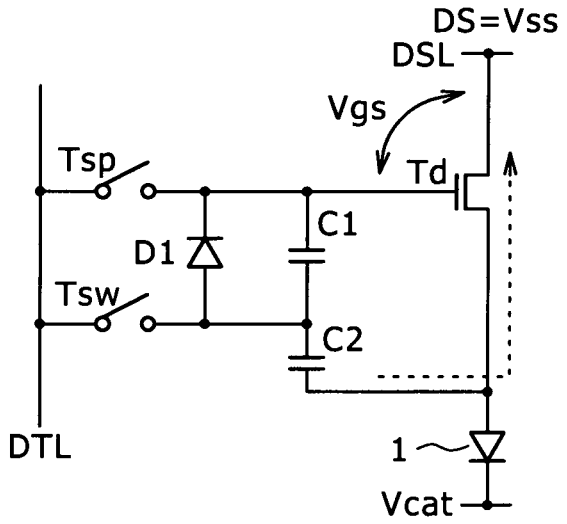

The initial voltage Vss is set lower than the sum of the threshold voltage Vthel and the cathode potential Vcat of the organic EL element 1. In short, the initial voltage Vss is set so as to satisfy Vss<Vthel+Vcat. Consequently, the organic EL element 1 emits no light, and the power supply controlling line DSL serves as the source of the driving transistor Td as seen in FIG. 4B. At this time, the anode of the organic EL element 1 is charged up to the initial voltage Vss. In other words, in FIG. 3, the source voltage of the driving transistor Td drops down to the initial voltage Vss.

At time t1, the signal line DTL is set to the potential of the reference value potential Vofs by the horizontal selector 11. Thereafter, at time t2, the sampling transistor Tsp and switching transistor Tsw are turned on in response to the scanning pulses WSa and WSb.

Figure 4C:
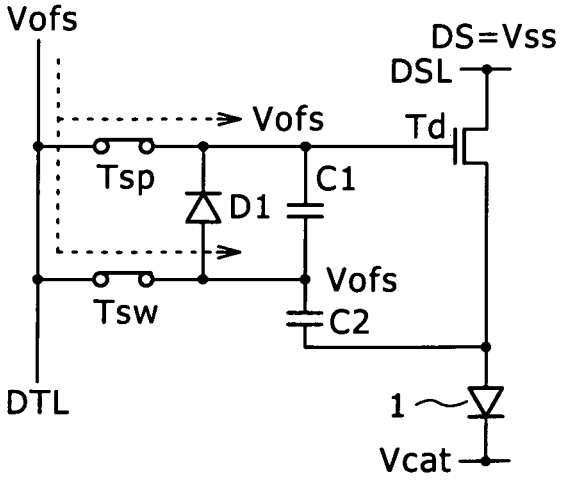

Consequently, the gate potential of the driving transistor Td and the point A are made equal to the potential of the reference value potential Vofs as seen in FIG. 4C.

At this time, the gate-source voltage of the driving transistor Td has the value of Vofs−Vss. Here, to set the gate potential and the source potential of the driving transistor Td sufficiently higher than the threshold voltage Vth of the driving transistor Td makes preparations for a threshold value correction operation. Accordingly, it is necessary for the reference value potential Vofs and the initial voltage Vss to be set so as to satisfy Vofs−Vss>Vth.

It is to be noted that the light detection element D1 has little influence on the gate of the driving transistor Td if the organic EL element 1 emits no light and the light detection element D1 is operating in the off region.

A threshold value correction operation is carried out within a period from time t3 to time t4.

In this instance, when the signal line potential is the reference value Vofs, the power supply pulse DS of the power supply controlling line DSL is set to the driving voltage Vcc in a state wherein the sampling transistor Tsp and the switching transistor Tsw are in an on state.

Figure 5A:
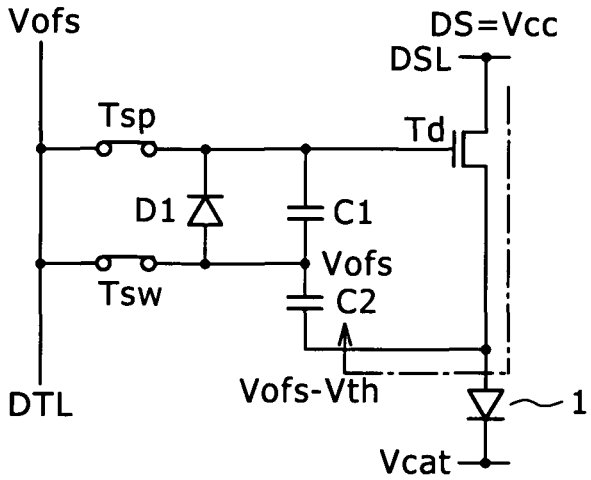
Figure 5B:
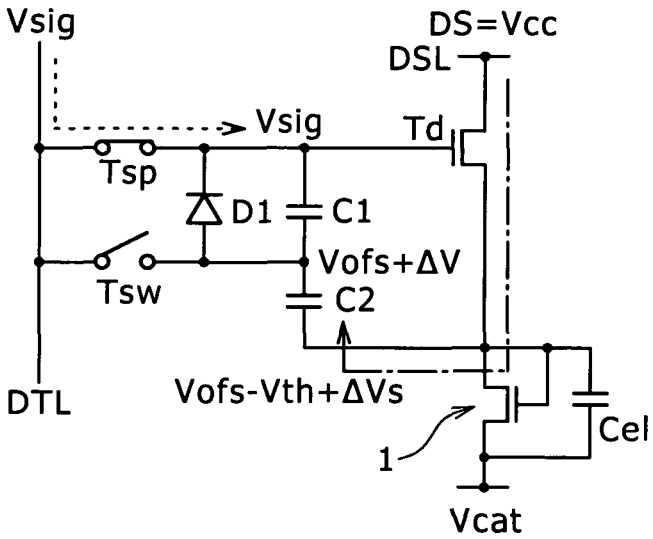
Figure 5C:
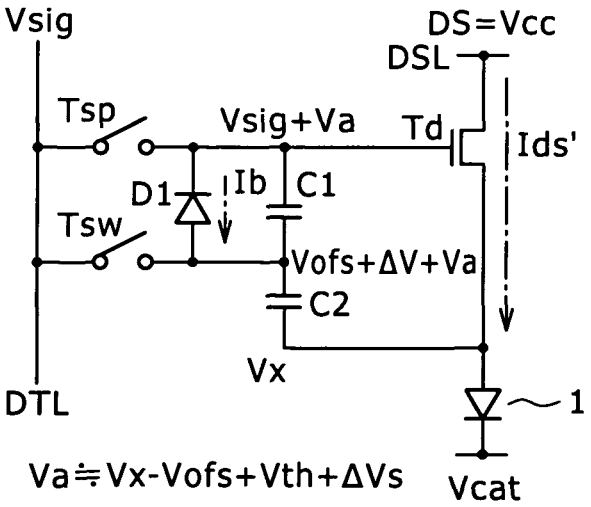

Consequently, the anode of the organic EL element 1 serves as the source of the driving transistor Td, and current flows as seen in FIG. 5C and the source potential of the driving transistor Td begins to rise.

Then, after lapse of a fixed period of time, the source potential of the driving transistor Td becomes equal to Vofs−Vth. Thereafter, at time t4, the scanning pulses WSa and WSb fall, and the sampling transistor Tsp and the switching transistor Tsw are turned off.

At time t5, the signal value Vsig is applied to the signal line DTL from the horizontal selector 11, and then within a period from time t6 to time t7, signal value writing and mobility correction are carried out.

In particular, at time t6, the scanning pulse WSa rises to turn on the sampling transistor Tsp. It is to be noted that the scanning pulse WSb does not vary and the switching transistor Tsw remains in an off state.

In particular, at time t6, since the sampling transistor Tsp is turned on first, a potential as the signal value Vsig is inputted to the gate of the driving transistor Td.

At this time, since the driving potential Vcc is applied to the power supply controlling line DSL, the driving transistor Td supplies current corresponding to the gate-source voltage Vgs to increase the source voltage.

At this time, if the source voltage of the driving transistor Td does not exceed the sum of the threshold voltage Vthel and the cathode potential Vcat of the organic EL element 1, that is, if the leak current of the organic EL element 1 is considerably smaller than the current flowing to the driving transistor Td, then the current of the driving transistor Td is used to charge up the holding capacitor C2 and the capacitor Cel (the parasitic capacitance of the organic EL element 1).

Figure 16A:
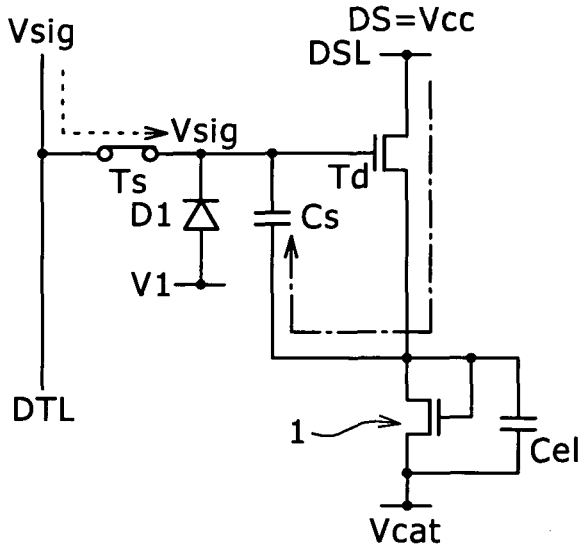
Figure 16B:
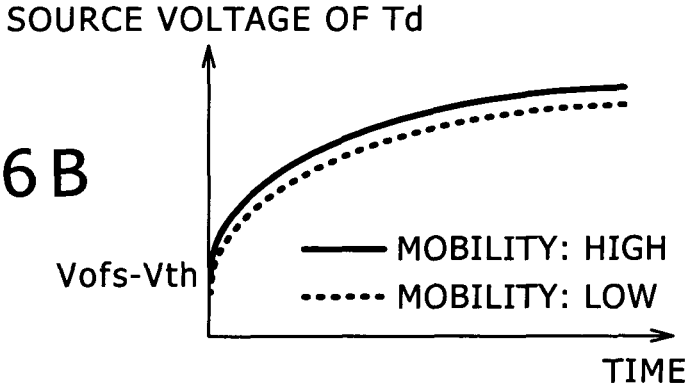
Figure 16C:
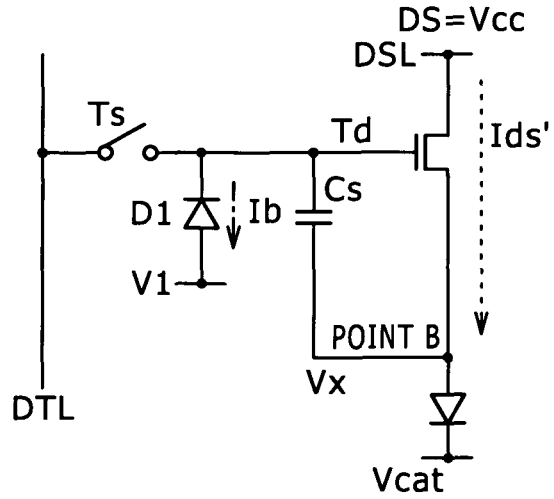

Then at this time, since the threshold value correction operation of the driving transistor Td has been completed, the current supplied from the driving transistor Td represents the mobility μ. In particular, where the mobility is high, the amount of current at this time is great, and also the speed of the rise of the source potential is high. On the contrary, where the mobility is low, the amount of current at this time is small, and also the speed of the rise of the source potential is low (refer to FIG. 16B). Consequently, the gate-source voltage Vgs of the driving transistor Td decreases reflecting the mobility, and after lapse of a fixed period of time, it becomes equal to the voltage with which the mobility is corrected fully.

It is to be noted that the light detection element D1 has little influence on the gate of the driving transistor Td if the organic EL element 1 emits no light and the light detection element D1 is operating in the off region.

After all, after lapse of a fixed period of time from time t6 at which the signal writing and the mobility correction are started, the potential at the point A becomes equal to Vofs+ΔV and the source potential of the driving transistor Td becomes equal to Vofs−Vth+ΔVs.

Here, ΔV is the sum of the gate voltage variation amount of the driving transistor Td inputted through the capacitor C1 and the source voltage variation amount of the driving transistor Td inputted through the capacitor C2 upon mobility correction.

Meanwhile, ΔVs is the sum of the potential variation amount at the point A inputted through the capacitor C2 and the variation amount of the source voltage upon mobility correction as seen in FIG. 5B.

After the mobility correction operation ends, at time t7, the scanning pulse WSa falls to turn off the sampling transistor Tsp so that the organic EL element 1 emits light as seen in FIG. 5C.

Since the gate-source voltage of the driving transistor Td is fixed, the driving transistor Td supplies current Ids' to the organic EL element 1. The anode voltage of the organic EL element 1 rises to a potential Vx at which the current Ids' is supplied to the organic EL element 1, and the organic EL element 1 emits light.

At this time, the light detection element D1 supplies current Ib from one to the other of the terminals of the capacitor C1 in response to the amount of received light from the organic EL element 1 to vary the gate potential of the driving transistor Td thereby to adjust the current Ids' to flow to the organic EL element 1.

It is to be noted that, while the gate voltage of the driving transistor Td is Vsig+Va and the potential at the point A is Vofs−ΔV+Va in FIG. 5C, Va≈Vx−Vofs+Vth−ΔVs.

Operation of one cycle of the pixel circuit 10 is carried out in such a manner as described above.

In the pixel circuit 10 according to the present embodiment, the light detection element D1 is connected across the capacitor C1. The potential difference across the capacitor C1 upon emission of light is Vsig−Vofs−ΔV. In other words, the potential difference across the light detection element D1 does not include the threshold voltage Vth of the driving transistor Td. This signifies that the threshold voltage Vth of the driving transistor Td does not have an influence on the voltage across the light detection element D1.

Further, the voltage ΔV includes a value of the variation amount of the source voltage of the driving transistor Td inputted through the capacitor C2 upon mobility correction. Since the value of the variation amount has a fixed ratio to the variation amount of the source voltage, the voltage across the light detection element D1 is little influenced by the difference in mobility dispersion.

Since the voltage across the light detection element D1 does not rely upon the threshold voltage of the driving transistor Td and is little influenced by the mobility dispersion in this manner, the voltage applied to the light detection element D1 is substantially fixed and the operating point of the light detection element D1 does not disperse by a great amount.

As a result, a dispersion in current arising from a dispersion in operating points of the light detection element D1 for each pixel can be reduced.

Consequently, an emitted light amount adjustment operation free from a dispersion for each pixel is implemented, and correction against a screen burn can be carried out with a high degree of accuracy. Therefore, it is possible to prevent appearance of a drawback in picture quality such as unevenness or roughness and obtain an image of uniform and good quality.

4. Second Pixel Circuit Configuration

Figure 6:
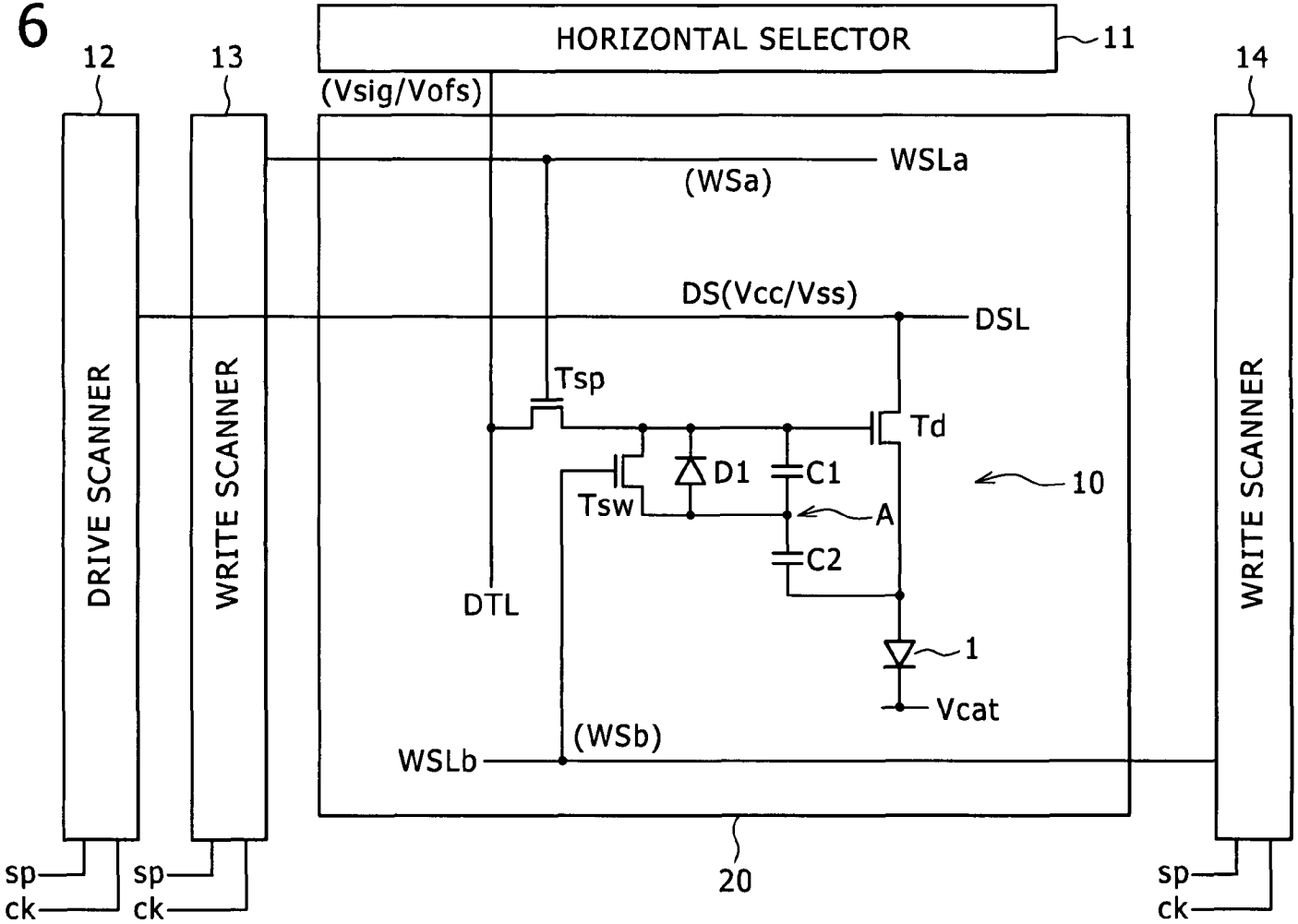
FIG. 6 is a block circuit diagram of a pixel circuit according to a second embodiment of the present invention.

An example of a configuration of a second pixel circuit 10 according to a second embodiment of the present invention is shown in FIG. 6.

The configuration of the pixel circuit 10 shown in FIG. 6 is similar to that of the first pixel circuit configuration except that the source and the drain of the switching transistor Tsw are connected to the opposite ends of the light detection element D1.

In other words, the switching transistor Tsw is connected to the node between the two capacitors C1 and C2 and the gate of the driving transistor Td.

The configuration of the other part and the circuit operation of the pixel circuit are similar to those described hereinabove with reference to FIGS. 2 to 5C.

In this instance, since the switching transistor Tsw is not connected to the signal line DTL, the parasitic capacitance of the signal line DTL can be reduced. This is advantageous in increase of operation speed, increase of the definition and increase of the size of the screen of the display apparatus.

5. Third Pixel Circuit Configuration

Figure 7:
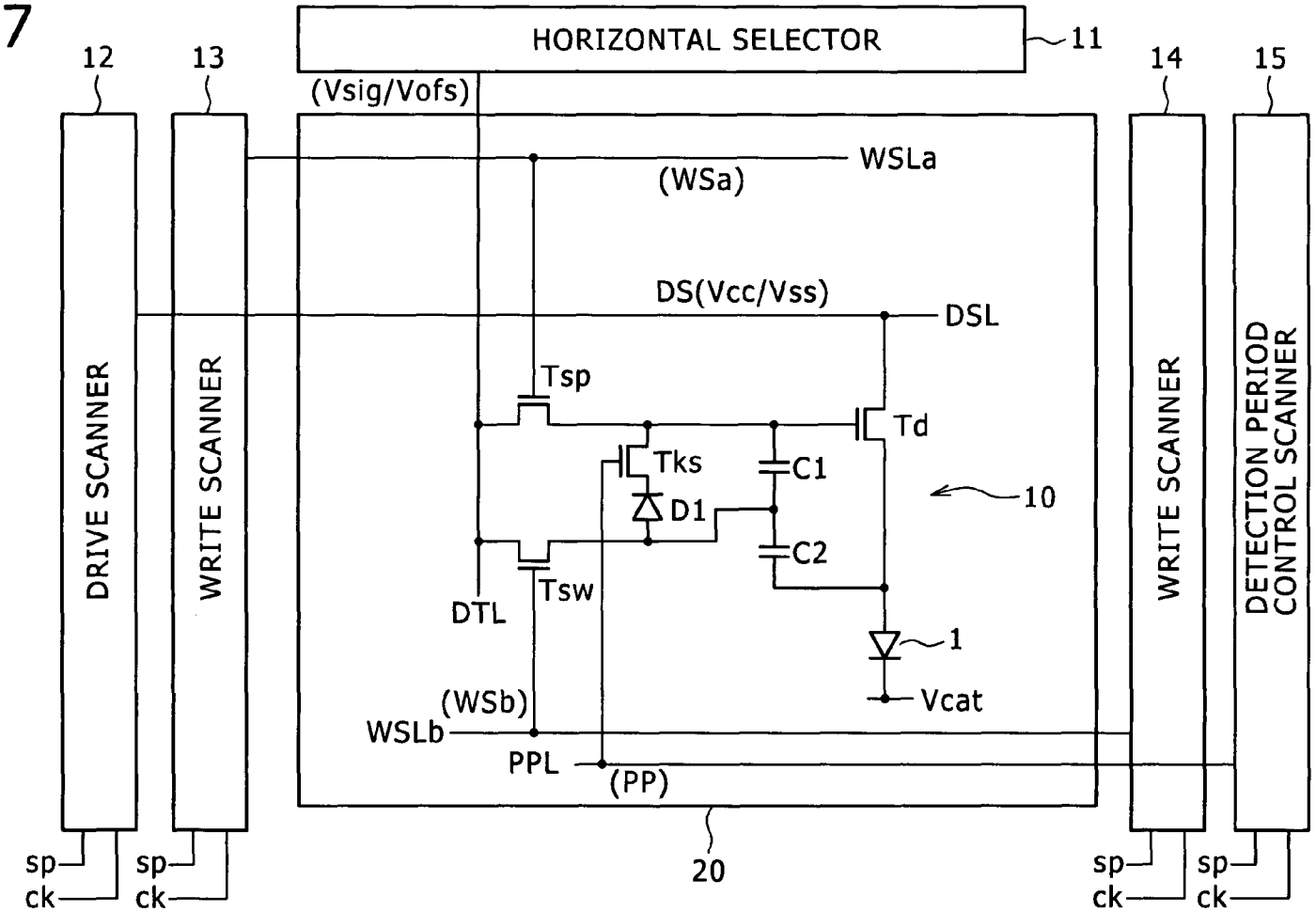
FIG. 7 is a block circuit diagram of a pixel circuit according to a third embodiment of the present invention.

A circuit configuration of a third pixel circuit according to a third embodiment of the present invention is described with reference to FIGS. 7 and 8.

The pixel circuit 10 shown in FIG. 7 has a similar configuration to that described hereinabove with reference to FIG. 2 but is different in that a detection period controlling transistor Tks is inserted between the gate of the driving transistor Td and the light detection element D1.

In particular, the light detection element D1 and the detection period controlling transistor Tks are connected in series between the gate of the driving transistor Td and the node between the capacitors C1 and C2.

Further, as scanners for driving the pixel circuits, a detection period control scanner 15 is provided in addition to the drive scanner 12 and write scanners 13 and 14.

Meanwhile, detection period controlling lines PPL are provided individual lines on the pixel array 20 such that they extend in the direction of a row, and the detection period control scanner 15 supplies a detection period control pulse PP to the detection period controlling lines PPL.

The detection period controlling transistor Tks is connected at the gate thereof to a corresponding detection period controlling line PPL.

Figure 8:
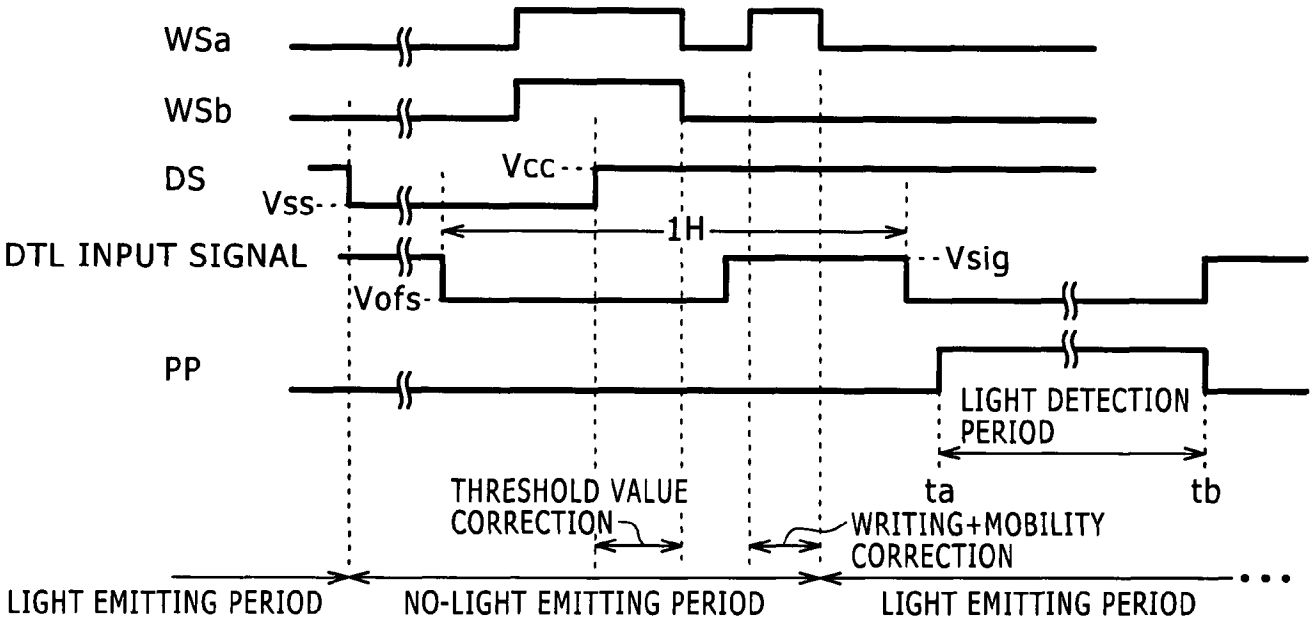
FIG. 8 is a timing chart illustrating operation waveforms of the pixel circuit of FIG. 7.
Figure 9A:
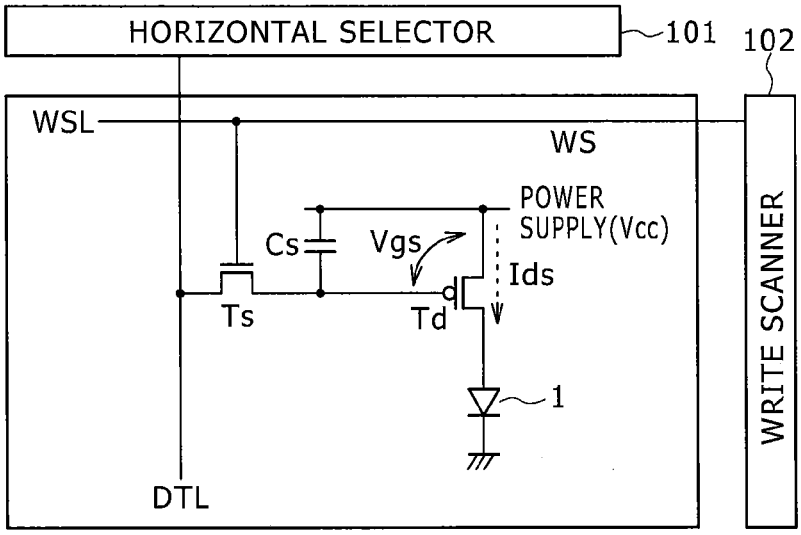
FIG.9A RELATED ART
FIG. 9A is a circuit diagram of a related art pixel circuit and FIG. 9B is a diagrammatic view illustrating an I-V characteristic of an organic EL element.
Figure 9B:
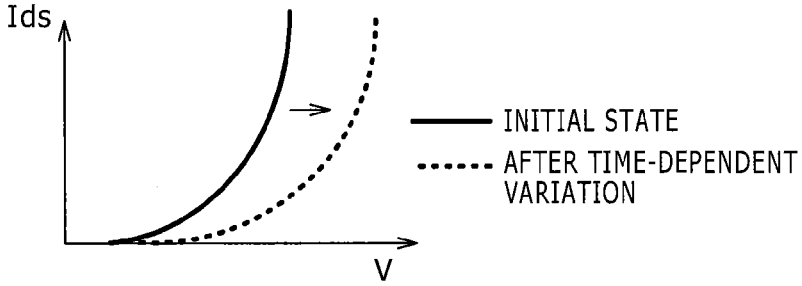
FIG.9B RELATED ART

In this instance, while the scanning pulses WSa and WSb, power supply pulse DS and DTL input signal are illustrated in FIG. 8, they are similar to those illustrated in FIG. 3.

In addition, the detection period control pulse PP is applied to the detection period controlling line PPL by the detection period control scanner 15.

As seen in FIG. 8, the detection period control pulse PP has the L level within a no-light emitting period, but has the H level within a period from time ta to time tb, that is, a light detection period, within a light emission period.

When the detection period control pulse PP indicates the H level, the detection period controlling transistor Tks conducts and the light detection element D1 supplies current in accordance with a received light amount.

In particular, in the present example, an adjustment operation of the emitted light amount of the organic EL element 1 by the light detection element D1 is carried out only within the light detection period, that is, within the period from time ta to time tb.

Accordingly, if the length of the period within which the detection period control pulse PP has the H level by the detection period control scanner 15 is set, then the adjustment operation period can be set arbitrarily. Naturally, also it is possible to vary the adjustment operation period.

If the present example is used such that the light detection period can be set freely, then, for example, when correction against a screen burn is applied excessively, such a countermeasure as to reduce the adjustment operation period by the light detection element D1 can be taken, or when such correction is applied insufficiently, such a countermeasure as to increase the adjustment operation period can be taken. By the countermeasure, it is possible to achieve appropriate adjustment or setting for individual actual display apparatus.

While the embodiments of the present invention are described above, the present invention is not limited to the embodiments described above but naturally allows various modifications and alteration.

The present application contains subject matter related to that disclosed in Japanese Priority Patent Application JP 2009-115195 filed in the Japan Patent Office on May 12, 2009, the entire content of which is hereby incorporated by reference.

What is claimed is:

1. A pixel circuit, comprising:

a light emitting element;

a driving transistor for applying current to said light emitting element in response to a signal value applied between a gate and a source thereof when a driving voltage is applied between a drain and the source thereof;

first and second capacitors connected in series between the gate and the source of said driving transistor;

a sampling transistor connected between the gate of said driving transistor and a predetermined signal line;

a switching transistor connected to supply a potential of said signal line to a node between said first and second capacitors; and a light detection element connected between the gate of said driving transistor and the node between said first and second capacitors for supplying current of a current amount in accordance with an emitted light amount of said light emitting element.

2. The pixel circuit according to claim 1, wherein said switching transistor is connected between the node of said first and second capacitors and said signal line.

3. The pixel circuit according to claim 1, wherein said switching transistor is connected between the node between said first and second capacitors and the gate of said driving transistor.

4. The pixel circuit according to claim 1, wherein said light detection element and a detection period controlling transistor are connected in series between the gate of said driving transistor and the node between said first and second capacitors.

5. The pixel circuit according to claim 1, wherein said light detection element is formed from a diode connection of a transistor.

6. A display apparatus, comprising:

a plurality of signal lines disposed on a pixel array, in which a plurality of pixel circuits are disposed in a matrix, so as to extend in the direction of a column;

a plurality of power supply controlling lines, a plurality of first write controlling lines and a plurality of second write controlling lines disposed on said pixel array so as to extend in the direction of a row; and a light emission driving section configured to drive said power supply controlling lines, first write controlling lines and second write controlling lines, and apply the signal value to each of said pixel circuits of said pixel array through said signal lines to cause said pixel circuits to emit light with a luminance corresponding to the signal value;

said pixel circuits being individually disposed at crossing points between said signal lines and said power supply controlling lines, first write controlling lines and second write controlling lines, each of said pixel circuits including a light emitting element, a driving transistor for applying current to said light emitting element in response to a signal value applied between a gate and a source thereof when a driving voltage is applied between a drain and the source thereof, first and second capacitors connected in series between the gate and the source of said driving transistor, a sampling transistor connected between the gate of said driving transistor and an associated one of said signal lines and controlled between a conducting state and a non-conducting state with a potential of an associated one of said first write controlling lines, a switching transistor connected to supply a potential of said signal line to a node between said first and second capacitors and controlled between a conducting state and a non-conducting state with a potential of an associated one of said second write controlling lines, and a light detection element connected between the gate of said driving transistor and the node between said first and second capacitors for supplying current in accordance with an emitted light amount of said light emitting element.

7. The display apparatus according to claim 6, wherein said light emission driving section includes:

a signal selector for supplying a potential as the signal value and the reference value to said signal lines disposed on said pixel array so as to extend in the direction of a column;

a first write scanner for driving said first write controlling lines disposed on said pixel array so as to extend in the direction of a row to introduce the potential of said signal lines to said pixel circuits;

a second write scanner for driving said second write controlling lines disposed on said pixel array so as to extend in the direction of a row to introduce the potential of said signal lines to said pixel circuits; and a drive controlling scanner for applying a driving voltage to said driving transistor of said pixel circuits using said power supply controlling lines disposed on said pixel array so as to extend in the direction of a row, each of said pixel circuits carrying out, as a light emission operation of one cycle, a threshold value correction operation of said driving transistor by rendering said sampling transistor conducting and said switching transistor under the control of said first and second write scanners, within a period within which the potential as the reference value is applied to the associated signal line by said signal selector, to fix the gate potential of said driving transistor and the potential at the node between said first and second capacitors to the reference value and applying, in this state, the driving voltage to said driving transistor from said driving control scanner, writing of the signal value and a mobility correction operation of said driving transistor by rendering said sampling transistor conducting and rendering said switching transistor non-conducting under the control of said first and second write scanners, within another period within which the potential as the signal value is applied to the associated signal line from said signal selector, and emission of light from said light emitting element with a luminance in accordance with the signal value by supplying, after the writing of the signal value and the mobility correction, the current in accordance with a gate-source voltage of said driving transistor to said light emitting element.

8. The display apparatus according to claim 6, wherein said switching transistor is connected between the node of said first and second capacitors and said signal line.

9. The display apparatus according to claim 6, wherein said switching transistor is connected between the node between said first and second capacitors and the gate of said driving transistor.

10. The display apparatus according to claim 6, further comprising:

a plurality of detection period controlling lines disposed on said pixel array so as to extend in the direction of a row;

said light detection element and a detection period controlling transistor, which is controlled between a conducting state and a non-conducting state in response to a potential of an associated one of said detection period controlling lines, being connected in series between the gate of said driving transistor and the node between said first and second capacitors;

said light emission driving section including a detection period controlling scanner for driving a plurality of detection period controlling lines, which are disposed on said pixel array so as to extend in the direction of a row, to control an operation period of said light detection element.

11. A driving method for a pixel circuit which includes a light emitting element, a driving transistor for applying current to said light emitting element in response to a signal value applied between a gate and a source thereof when a driving voltage is applied between a drain and the source thereof, first and second capacitors connected in series between the gate and the source of said driving transistor, a sampling transistor connected between the gate of said driving transistor and a predetermined signal line, a switching transistor connected to supply a potential of said signal line to a node between said first and second capacitors, and a light detection element connected between the gate of said driving transistor and the node between said first and second capacitors for supplying current of a current amount in accordance with an emitted light amount of said light emitting element, the driving method comprising the steps carried out within a write emission operation period of one cycle of:

applying a potential as the reference value to the signal line and rendering the sampling transistor and the switching transistor conducting to fix a gate potential of the driving transistor and a potential at the node between the first and second capacitors to the reference value;

applying a driving voltage to the driving transistor to execute a threshold value correction operation of the driving transistor; and applying a potential as the signal value to the signal line and rendering the sampling transistor conducting while rendering the switching transistor non-conducting so that writing of the signal value and a mobility correction operation of the driving transistor, whereafter current corresponding to a gate-source voltage of the driving transistor is supplied to the light emitting element to carry out emission of light from the light emitting element with a luminance corresponding to the signal value.

* * * * *